US006983541B2

(12) United States Patent
Kaczorowski

(10) Patent No.: US 6,983,541 B2
(45) Date of Patent: Jan. 10, 2006

(54) UTILITY KNIFE WITH RETRACTING SHIELD

(75) Inventor: Damian Kaczorowski, San Mateo, CA (US)

(73) Assignee: Orcon Corporation, Union City, CA (US)

( * ) Notice: Subject to any disclaimer, the term of this patent is extended or adjusted under 35 U.S.C. 154(b) by 59 days.

(21) Appl. No.: 10/388,830

(22) Filed: Mar. 14, 2003

(65) Prior Publication Data

US 2004/0177514 A1 Sep. 16, 2004

(51) Int. Cl.
*B26B 3/06* (2006.01)
*B26B 3/08* (2006.01)

(52) U.S. Cl. ..... 30/286; 30/2

(58) Field of Classification Search ..... 30/2, 30/151, 339, 125, 286, 293
See application file for complete search history.

(56) References Cited

U.S. PATENT DOCUMENTS 3,906,625 A * 9/1975 Gringer ..... 30/125
4,757,612 A * 7/1988 Peyrot ..... 30/151
5,241,750 A * 9/1993 Chomiak ..... 30/2
6,233,832 B1 * 5/2001 Berns ..... 30/162
6,330,749 B1 * 12/2001 Khachatoorian et al. ..... 30/162

* cited by examiner

*Primary Examiner*—Douglas D. Watts
(74) *Attorney, Agent, or Firm*—O'Melveny & Myers LLP

(57) ABSTRACT

A utility knife has a handle and a replaceable blade fixed to the handle. The blade has a cutting edge extending from the handle along an axis for a distance. The utility knife includes a movement mechanism, which may be at least partially enclosed by the handle. The movement mechanism is adapted to provide reversible motion along relative to the blade. A shield is connected to the movement mechanism and disposed adjacent to the blade, whereby the shield is movable between an extended position covering the cutting edge and a retracted position exposing the cutting edge. When in a retracted position, the shield may be inside or closely adjacent to the handle, so as to not interfere with handling of the knife.

25 Claims, 7 Drawing Sheets

FIG. 1A
PRIOR ART
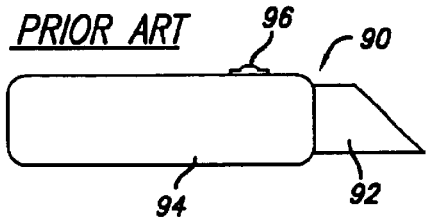
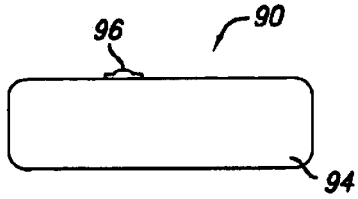
FIG. 1B
PRIOR ART
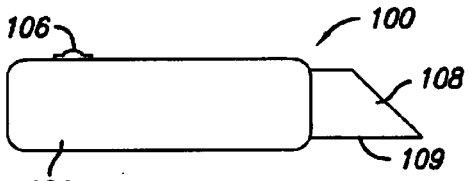
FIG. 2A
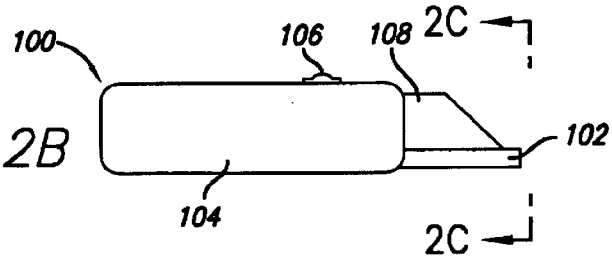
FIG. 2B
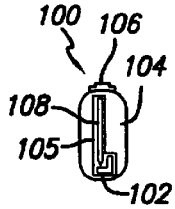
FIG. 2C
FIG. 3A
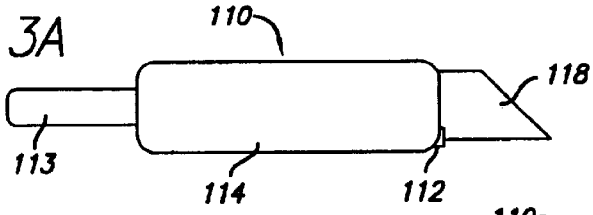
FIG. 3B
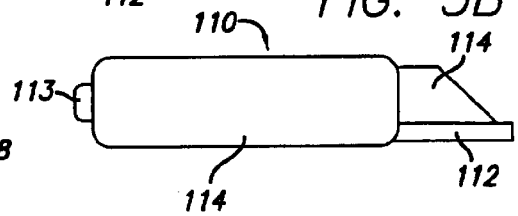
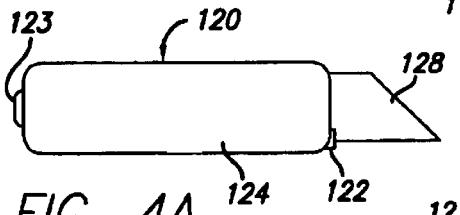
FIG. 4A
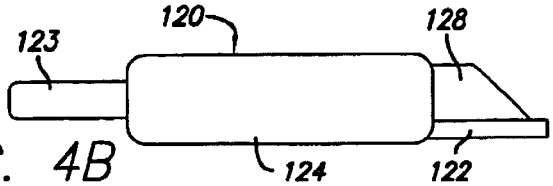
FIG. 4B

UTILITY KNIFE WITH RETRACTING SHIELD

BACKGROUND OF THE INVENTION

1. Field of the Invention

The present invention relates to replaceable-blade utility knives, such as used in the construction trades for cutting sheet materials by hand.

2. Description of Related Art

Hand-held utility knives that have a thin cutting blade with at least one razor-like edge are ubiquitous tools found in the toolbox of almost every tradesman and do-it-yourselfer. These utility knives come in different styles and types, including disposable and reusable types. Reusable types typically include a metallic handle and are generally regarded as stronger and more reliable than disposable, plastic-handled types. Therefore, reusable utility knives are preferred by professionals and serious craftspeople. With disposable knives, the entire knife is discarded when the blade is spent. With reusable knives, only the blade is discarded and replaced with a new blade; hence, such knives may also be referred to as replaceable-blade utility knives.

Replaceable-blade utility knives are generally available in two basic types: retractable-blade knives and fixed-blade knives. Retractable-blade knives, such as knife 90 shown in FIGS. 1A–B, typically use a single-edged blade 92 that is mounted to a sliding blade holder inside of handle 94. The sliding blade holder is connected to a button 96 on the outside of handle 94. By sliding the button 96 along handle 94 to the position shown in FIG. 1B, blade 92 may be retracted into handle 94.

Retractable-blade utility knives are convenient light-duty cutting tools, and their retractable blade enhances their convenience and safety. At the same time, however, the use of a sliding blade holder adds a certain amount of imprecision to the blade mount and weakens the connection between the blade and the handle. For this reason, many professionals and serious craftspeople prefer to use a fixed-blade utility knife for more demanding applications, such as the installation of wall-to-wall carpeting or precision detailed cutting.

As the name implies, in a fixed-blade utility knife, the cutting blade is securely fixed to the handle of the knife. To secure the blade, a thumbscrew or other removable fastener may be used, thereby facilitating convenient replacement of spent blades. But when in use, the blade is securely clamped in place relative to the handle, providing a more trustworthy and precise cutting edge. Consequently, the cutting edge of the blade remains exposed when the knife is not in use, such as when lying in the tool box or carried in a tool pouch. The exposed blade may be covered using a removable safety cover, but such covers are prone to become lost, or may be perceived as inconvenient by some users.

Accordingly, there is a need for a replaceable-blade utility knife that combines the safety and convenience of a retractable-blade knife with the precision and strength of a fixed-blade knife, at an affordable cost.

SUMMARY OF THE INVENTION

The present invention provides a replaceable-blade utility knife that combines the safety and convenience of a retractable-blade knife with the precision and strength of a fixed-blade knife, at an affordable cost. In essence, the knife blade is fixed to the handle, as in a conventional fixed-blade utility knife. Unconventionally, however, a retractable shield (blade guard) can be extended from the handle when the knife is not in use, covering the cutting edges of the blade. The shield can be conveniently retracted out of the user's way and into the handle using an internal mechanism. The retractable shield does not interfere with the removal and replacement of spent cutting blades, which can be accomplished in a manner similar to that used for a conventional fixed-blade utility knife.

In an embodiment of the invention, the retractable shield is operated using a toggle-type spring-loaded reversing mechanism. The reversing mechanism uses a "push and click" operation like the plunger of a ball-point pen. To extend the shield, the plunger is depressed until the shield "clicks" into position. To retract the shield, another push on the plunger disengages the shield and activates a spring-loaded slider that pulls the shield into the handle. The convenient operation of the shield should be particularly appealing to busy professionals and others who desire the safety of a shielded blade without paying a penalty in convenience, strength, or precision.

A more complete understanding of the utility knife will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIGS. 1A and 1B are simplified conceptual views of a prior-art retractable-blade utility knife, respectively showing the cutting blade in extended and retracted positions.

FIGS. 2A and 2B are simplified conceptual views of a retractable-shield knife using an internal sliding mechanism attached to a sliding button, respectively showing the shield in retracted and extended positions.

FIG. 2C is an end view of the knife shown in FIG. 2B.

FIGS. 3A and 3B are simplified conceptual views of a retractable-shield knife using an internal sliding mechanism actuated by a rear-mounted plunger, respectively showing the shield in retracted and extended positions.

FIGS. 4A and 4B are simplified conceptual views of a retractable-shield knife using an internal toggle-type spring-loaded reversing mechanism actuated by a rear-mounted plunger, respectively showing the shield in retracted and extended positions.

DETAILED DESCRIPTION OF THE PREFERRED EMBODIMENT

Figure 5:
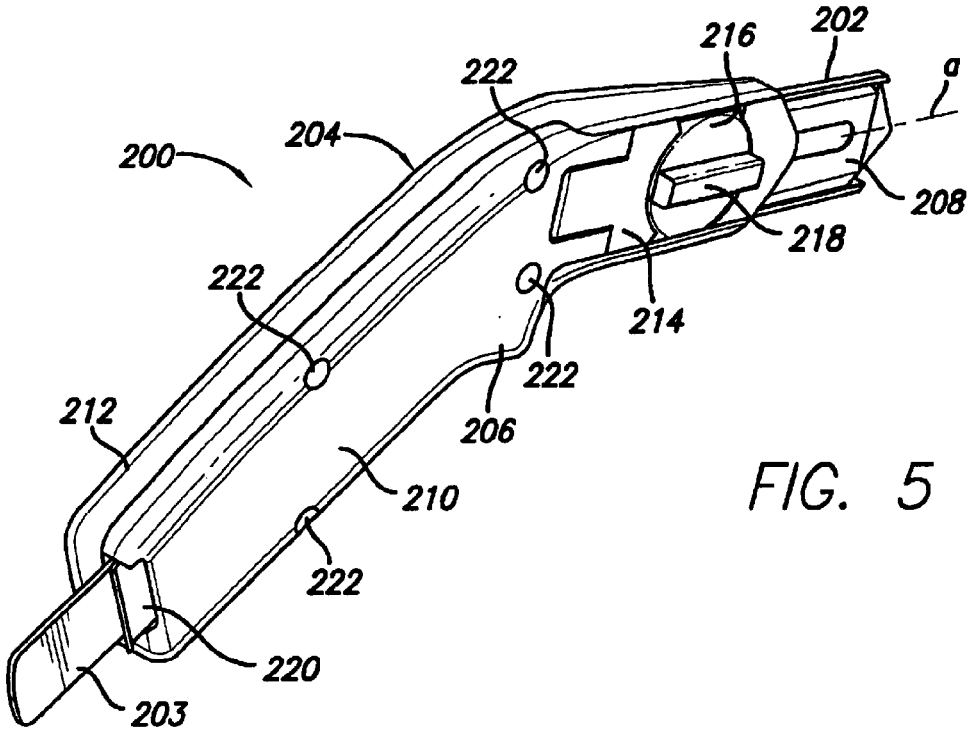
FIG. 5 is a perspective view of an exemplary utility knife according to the invention, with the retractable shield in an extended position.

The present invention provides a replaceable fixed-blade utility knife, that includes a retractable blade guard, also called a shield, for greater safety and convenience. In the detailed description that follows, like element numerals are used to designate like elements appearing in one or more of the figures.

In an embodiment of the invention, a retractable-shield knife 100 as shown in FIGS. 2A–C has a retractable shield 102 attached to a movement mechanism (not shown) internal to handle 104. The movement mechanism provides sliding motion, and is therefore referred to as a sliding mechanism. It should be appreciated, however, that the movement mechanism may, in the alternative or in addition, provide other types of motion, such as rotational movement. Blade 108 is fixed relative to handle 104, and has a cutting edge 109 that extends from the handle for a fixed distance. The sliding mechanism, in turn, is attached to a sliding button 106, by which the sliding action of shield 102 is actuated. Pushing the sliding button 106 to the left, to the position shown in FIG. 2A, actuates the sliding mechanism so as to retract the shield into the handle. Pushing the sliding button to the right, to the position shown in FIG. 2B, actuates the sliding mechanism to extend the retractable shield 102 to cover the cutting edge 109 of blade 108. An end view of knife 100 is shown in FIG. 2C. Shield 102 is free to move in and out of handle 104 through opening 105. Blade 108 may be fixed to handle 104 in any suitable manner.

In an alternative embodiment, as shown in FIGS. 3A–3B, a retractable-shield knife 110 may be provided with a shield 112 operated by an internal sliding mechanism, which is, in turn, actuated by a rear-mounted plunger 113. Motion of the plunger 113 causes a corresponding motion of the shield 112 in the same direction. FIG. 3A shows the shield in a retracted position; in this position the plunger is extended from handle 114 and the cutting edge of blade 118 is exposed. FIG. 3B shows the shield in an extended position, covering the cutting edge of the blade; in this position, the plunger has been pushed deeper inside of the handle 114.

Plunger 113 may be provided with a spring-loaded toggle mechanism, such as the examples discussed in connection with FIGS. 11 and 14 below. With a toggle mechanism, depressing the plunger when it is in the extended position moves it against the force of a spring to the position shown in FIG. 3B, where the plunger is latched in position. Depressing the plunger a second time releases the latch, and the plunger is returned by the stored spring force to the extended position shown in FIG. 3A. Knife 110 may additionally be provided with a safety latch (not shown), to prevent inadvertent toggling of the plunger that might otherwise expose blade 118 at an inopportune time.

Advantageously, a plunger-actuated mechanism provides a more direct coupling of sliding force to the retractable shield, as compared to the offset sliding button shown in FIGS. 2A–C. Disadvantageously, however, the plunger may be somewhat bulkier, and may interfere with handling of knife 110 when cutting; i.e., when shield 112 is in its retracted position. A further disadvantage is that the plunger, when equipped with a spring-loaded toggle mechanism, may be prone to inadvertently exposing the blade unless equipped with a separate safety lock.

Knife 120, shown in FIGS. 4A and 4B, offers all of the advantages of a plunger-actuated mechanism, while minimizing its disadvantages. In brief, knife 120 includes a reversing mechanism inside of handle 124, that generally reverses the direction of motion of shield 122, relative to actuator 123. Hence, when shield 122 is in a retracted position as shown in FIG. 4A, exposing the cutting edge of blade 128, plunger 123 is also retracted into handle 124. In this retracted position, plunger 123 is held in place by a toggle latch against a spring. Depressing plunger 123 releases the latch, causing the plunger 123 to extend under the force of a spring installed inside of handle 124 to the position shown in FIG. 4B. In this position, shield 122 is also extended, covering the cutting edge of blade 128. Thus, knife 120 provides at least two advantages: (1) the shield is maintained in position by the force of a spring when the cutting blade is not in use, and (2) the plunger is retracted into the handle and out of the user's way when knife is used for cutting; i.e., when the blade is exposed.

One of ordinary skill will understand knives 100, 110, and 120 to exemplify various basic types of retractable shield knives according to the invention. Further mechanical details that may be applied in the construction of these and other knives according to the invention should be apparent from the more particularized descriptions of the embodiments that follow. The first of these embodiments utilizes a double-edged, thin replaceable blade such as conventionally used in fixed-blade utility knives intended for cutting of carpeting, and the like. The second of these embodiments, also a fixed-blade design, utilizes a single-edged blade such as conventionally used in retractable-blade, general-purpose utility knives. While the present invention may be adapted for use with a blade of any type, use of a commonly-available utility blade such as those shown may enhance convenience for the user.

Figure 6:
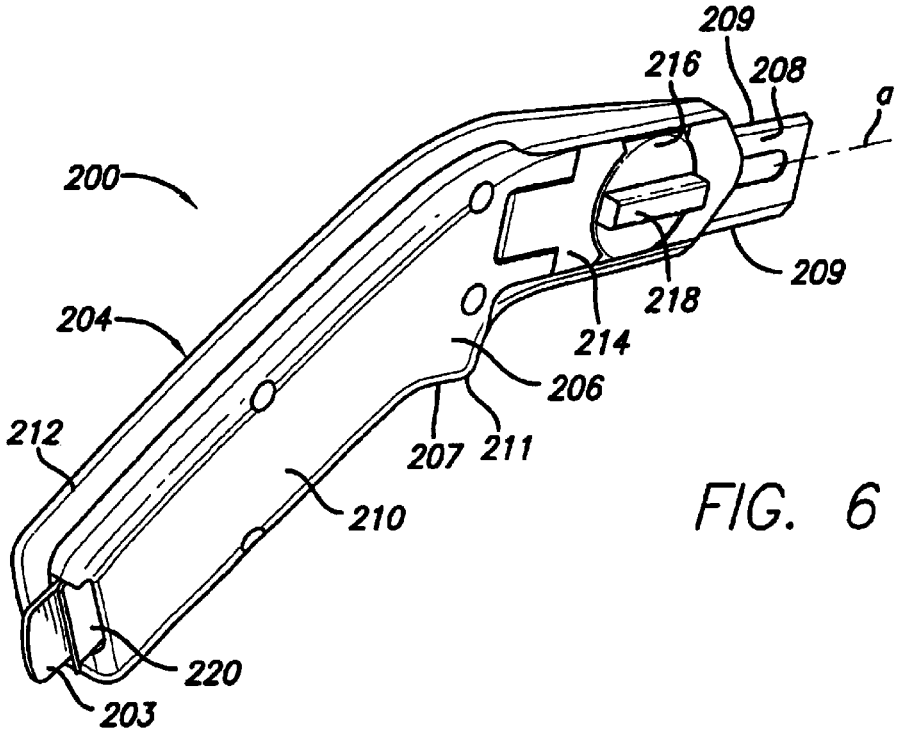
FIG. 6 is a perspective view of the knife shown in FIG. 5, with the retractable shield in a retracted position.
Figure 7:
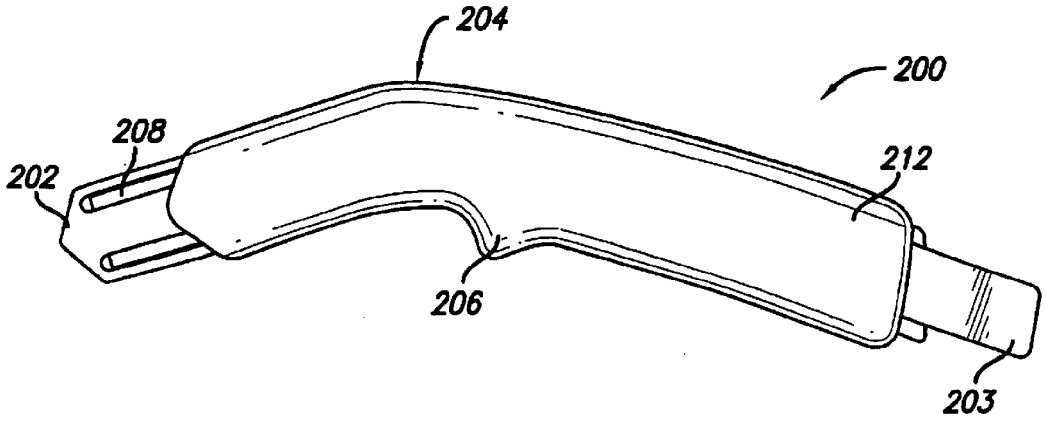
FIG. 7 is a left plan view of the knife shown in FIG. 5, with the retractable shield in an extended position.
Figure 8:
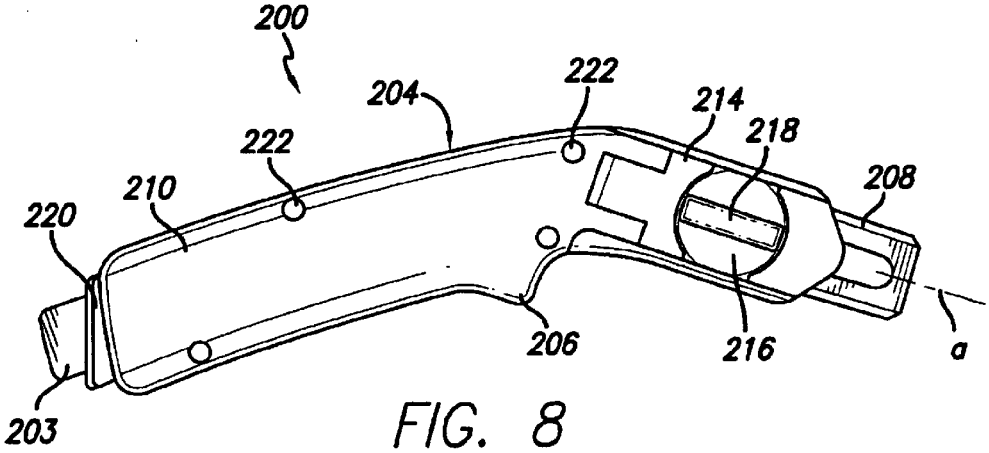
FIG. 8 is a right plan view of the knife shown in FIG. 5, with the retractable shield in a retracted position.
Figure 9:
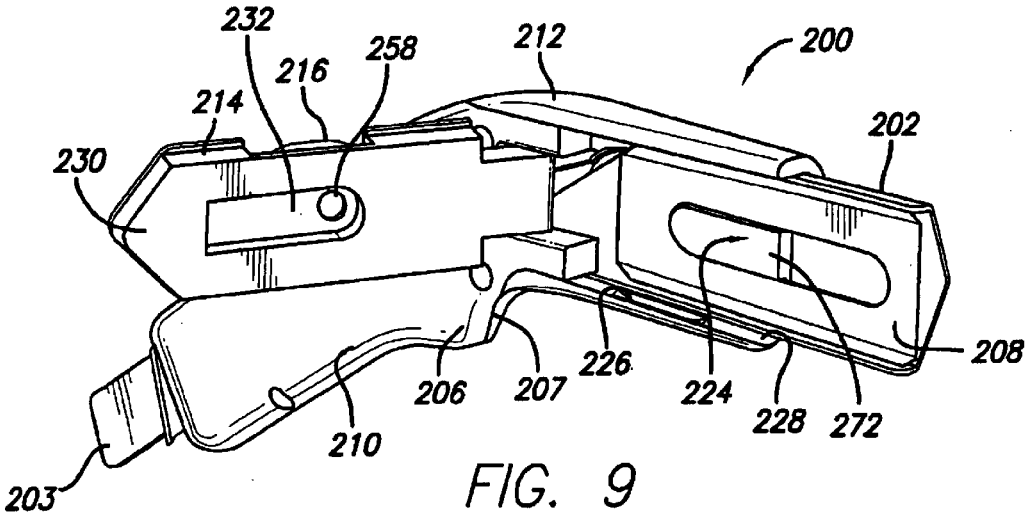
FIG. 9 is a perspective view of the knife shown in FIG. 5, with the retractable shield in an extended position and the blade access door swung open.
Figure 10:
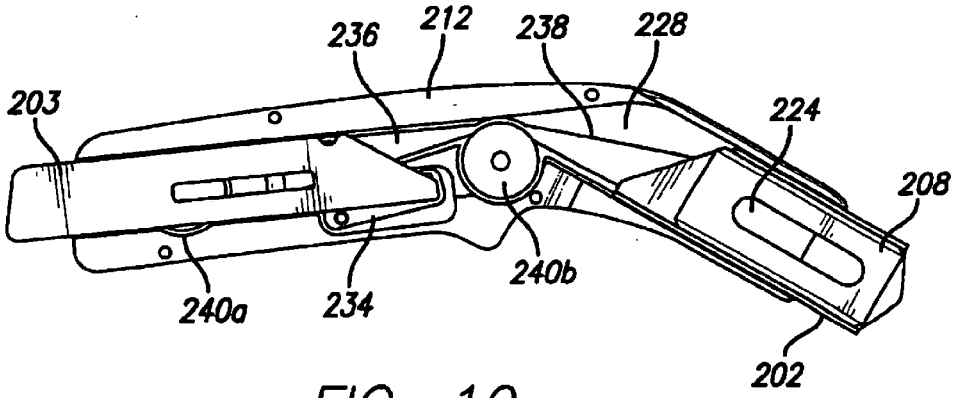
FIG. 10 is a right plan view of the knife shown in FIG. 5, with the right-side knife handle removed to reveal the internal shield-retracting mechanism.
Figure 11:
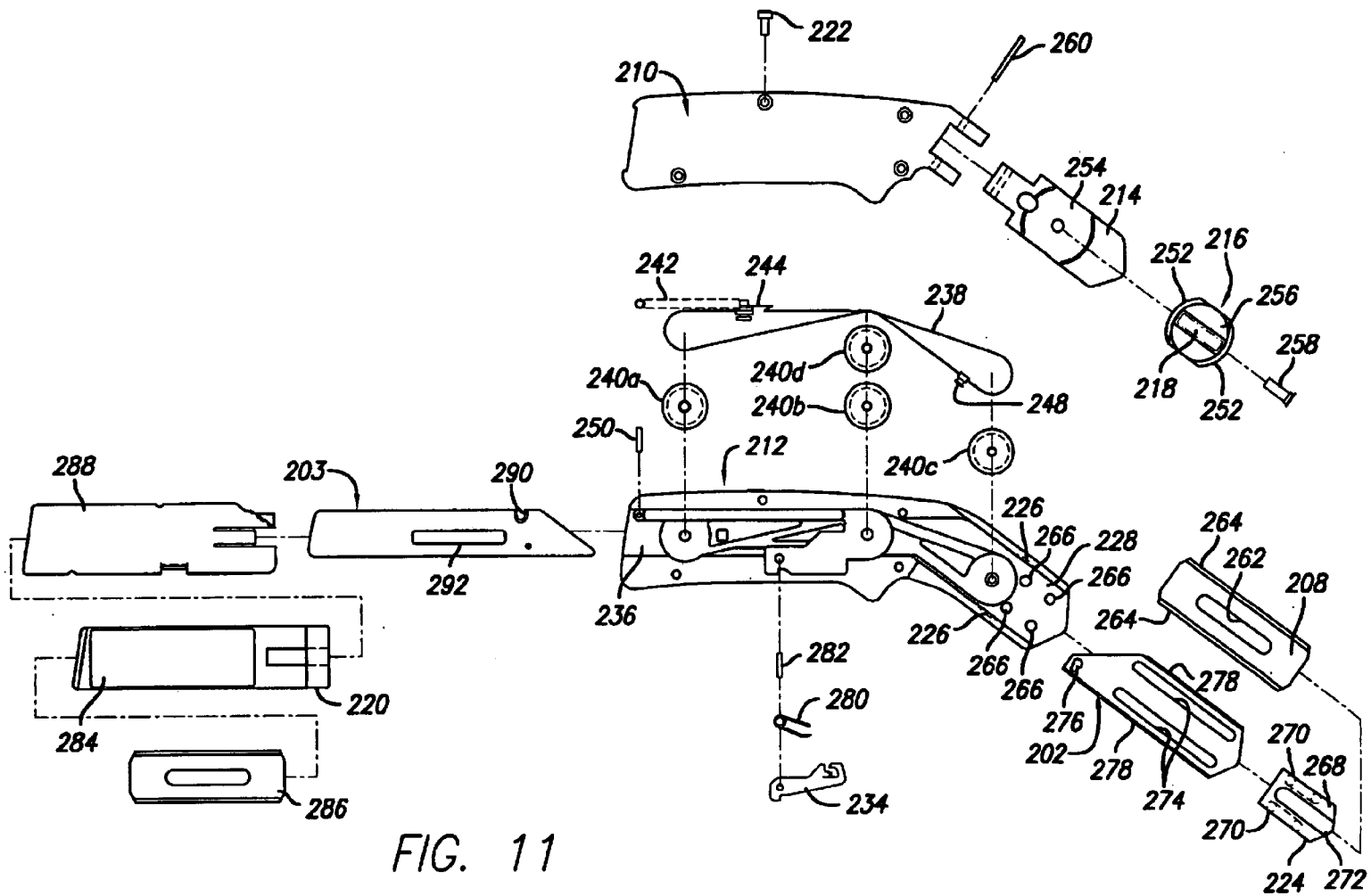
FIG. 11 is an exploded plan view of the knife shown in FIG. 5.

Referring generally to FIGS. 5–11, FIGS. 5–9 show various views of an exemplary utility knife 200 according to the invention. FIG. 10 shows a portion of knife 200, with a portion of the handle removed to reveal the movement mechanism and other parts positioned in the interior of the knife handle. FIG. 11 is an exploded assembly drawing showing individual parts of knife 200. Like knife 120 shown in FIGS. 4A–B, knife 200 comprises a cutting blade 208 fixed to a handle 204, and a plunger-type actuator 203 connected by a reversing mechanism to a retractable shield 202. FIGS. 5, 7, and 9 show knife 200 with shield 202 in an extended position, covering the edges of blade 208. FIGS. 6 and 8 show knife 200 with shield 202 retracted into handle 204.

Handle 204 comprises a right casing 210 and left casing 212. Casings 210, 212 may be fastened together using fasteners 220, and may include miscellaneous other internal and external small parts, including a cover piece 214 and clamp 216. Casings 210, 212 may be constructed of any suitable material, such as plastic or metal. In an embodiment of the invention, casings 210, 212 are cast aluminum alloy pieces. When assembled, handle 204 preferably presents a smooth, comfortable surface for gripping.

In addition, a finger grip 206 may be provided along an undersurface of the handle 204, to provide a more ergonomic handle. Finger grip 206 may comprise a generally smooth protrusion from handle 204, with contoured sides 207 shaped to fit between fingers of one hand, and a rounded tip 211. The finger grip may be positioned on handle 204 to fit between the index and middle fingers, and be symmetrical in shape so as to fit both right-handed and left-handed users. In addition, or in the alternative, finger grip 206 may be placed in a different position along handle 204, or additional finger grips may be placed on the handle, or may be omitted altogether. Use of a single finger grip 206 is believed to provide a more ergonomic handle than prior art utility knives, as well as contributing to an elegant but utilitarian appearance of the knife. Optionally, a gripping portion of the handle (e.g., to the left of cover piece 214 and grip 206 in FIG. 5) may be covered by a soft material suited for gripping, such as a synthetic rubber material (not shown).

For more comfortable gripping, the gripping portion of handle 204 may be inclined at an angle relative to axis 'a', as shown in FIGS. 5–8. Axis 'a' is an axis parallel to at least one cutting edge of blade 208. In the embodiment shown in FIGS. 5–9, blade 208 has two parallel cutting edges 209, as indicated in FIG. 6. Blade 208 is fixed to handle 204, and has cutting edges 209 extending for a fixed distance from handle 204. That is, blade 208 is essentially not movable relative to the handle, except when being removed and replaced with a new blade. Although the invention does not preclude the use of a moveable blade, a fixed-blade configuration is preferred. Blade 208 may comprise any suitable knife or razor blade. One of ordinary skill will recognize the exemplary blade 208 as one of a great variety of commonly-available utility blades.

Knife 200 further includes a retractable shield 202. Shield 202 comprises a piece of hard, durable material shaped to cover one or both cutting edges of blade 208. In the embodiment shown in FIGS. 5–9, shield 202 is a primarily flat metal piece with opposing lips 278 that cover the opposing cutting edges of blade 208. Referring to FIG. 11, shield 202 includes two guide slots 274 that cooperate with other features of the knife to guide the shield back and forth over its intended range of motion. Slots 274 may be formed to accommodate legs 270 of blade retainer 224. Shield 202 may also be guided by channel 228, and any other suitable features may be used to guide the shield. Shield 202 may additionally include an attachment feature 276 for attaching the shield to a movement mechanism.

Plunger 203 is connected to shield 202 by a movement mechanism, comprising pulleys 240*a–d* and cable 238. In an embodiment of the invention, the movement mechanism provides linear motion over a desired linear range for shield 202, in the direction of axis 'a'. The movement mechanism may, in the alternative, provide motion over an arcuate path. The movement mechanism may be located between casings 210, 212, such as in recess 236 in left casing 212. Cable 238 may comprise a loop of any suitable tensile material. A first attachment feature 244 on cable 238 attaches to a corresponding attachment 290 in plunger 203. A second attachment feature 248 attaches to shield 202. Pulleys 240*a–d* may be placed in suitable portions of recess 236 and fastened in place using any suitable fasteners. Loop 238 is looped around the pulleys, and may be retained by grooves in the pulley perimeters. Pulleys 240*b*, 240*d* may be stacked to guide loop 238 in opposing directions.

It should be apparent that placing the attachment features 244, 248 on opposite sides of loop 238 (as shown in FIG. 11) provides a reversing mechanism. That is, movement of the plunger 203 (and hence, the first attachment feature 244) from left to right causes a generally opposite movement from right to left of attachment feature 248 and its attached shield 202. In the alternative, the attachment features may be placed on the same side of loop 238, to provide a non-reversing mechanism.

The invention is not limited to knives that incorporate a loop-and-pulley type movement mechanism. Other types of movement mechanisms may be employed, and may also be mounted inside or adjacent to the knife handle. For example, other suitable linear movement mechanisms may include rack-and-pinion mechanisms, tongue-and-groove sliders, rails, rollers, worm gears, or other geared mechanisms. Rotating mechanisms may be used to provide motion over an arc. Cam/cam follower mechanisms may also be suitable. Instead of using a plunging or sliding actuator, the movement mechanism may be actuated by turning a knob, or the like. The depicted loop-and-pulley type mechanism, however, is believed advantageous for providing rapid shield movement with a toggled reversing action, using a relatively simple assembly.

A suitable spring, such as coil spring 242, may be attached to the movement mechanism and biased against handle 204. Pushing plunger 203 into handle 204 stretches spring 242, opposite ends of which are attached to handle 204 and loop 238, respectively. A pin 250 may be used to attached the spring to the left casing 212. To prevent the plunger and its attached loop from immediately springing back, the movement mechanism may additionally include a toggle latch 234, shown in FIG. 11. Latch 234 may be pinned to handle 204 using a suitable pin 282, and biased against a suitable spring 280. When shield 202 is fully retracted, toggle latch 234 drops into a latched position, preventing loop 238 from springing back under the tension of spring 242. Pushing plunger 203 a second time releases the latch, causing the plunger and shield 202 to extend from the handle, releasing energy stored in spring 242. Various toggle latches are known in the art, and any suitable latch may be used. In the alternative, or in addition, a manually-operated latch may be used to hold the shield 202 in an extended and/or retracted position. Disadvantageously, a manual latch may make the movement mechanism somewhat less convenient for a user to operate.

Referring to FIGS. 10 and 11, plunger 203 may also rest in recess 236. The plunger includes an attachment feature 290 for attaching to loop 238, as previously described. Plunger 203 may include a guide slot 292 to accommodate a corresponding guide post in recess 236, for guiding the back-and-forth motion of the plunger. The plunger may be formed from any durable material, for example, metal or plastic. Portions of the plunger that protrude from the handle should be free of sharp edges.

Blade 208 is fixed in position relative to handle 204 by cover piece 214, yet may readily be removed and replaced by loosening clamp 216 and pivoting the cover piece to an open position, such as shown in FIG. 9. When in this position, the blade is free to be lifted off of the retainer 224. A replacement blade may then be placed on the retainer, as shown. Or, the original blade may be replaced in a different position, for example, turned 180°.

A user of the knife may reposition the blade several times before it is spent and discarded. For example, the double-edged blade 208 has four useable cutting edge portions, only one of which is in use at any given time. Two of the four edge portions are encased between casings 210, 212, and two are exposed. The two exposed edge portions may be used successively by turning the entire knife over, or by opening the cover 214 and turning the blade over. In any case, it is desirable to provide a blade holding structure that permits convenient replacement or repositioning of the blade, as both actions may be frequently needed in the ordinary course of work.

Knife 200 embodies one such convenient blade holder. Referring generally to FIGS. 5, 9, and 11, cover piece 214 is connected to right casing 210 by pin 260, about which it can be pivoted. As shown in FIG. 9, a bearing surface 230 is provided on the underside of piece 214. The bearing surface bears against blade 208, holding it against the mounting surface 268 of retainer 224 when the cover 214 is closed and compressed by clamp 216. A relief well 232 is also provided in the underside of cover piece 214, to provide clearance for the central bar 272 of the retainer 224, thereby assuring contact between bearing surface 230 and blade 208.

Clamp 216 is rotatably fastened to the upper surface of the cover piece by a fastener 258, and is disposed in a central recess 254. The clamp includes a gripping feature 218 for permitting a user to rotate the clamp in the recess 254 around fastener 258, without loosening the fastener. Preferably, the gripping feature comprises a handle, such as bar 218, that can readily be grasped by hand, and turned. In the alternative, or in addition, the gripping feature may comprise a stud, indentation, ring, or other feature for gripping by hand or with a separate tool. As shown in FIG. 11, clamp 216 further comprises annular tapered edges 252 around portions of its outer periphery. Each edge 252 is relatively thin at one end, and is progressively tapered to a greater thickness around the circumference of the clamp. Hence, each edge 252 provides a ramp that may be wedged into an opposing recess 226 (one of two shown in FIG. 9) in the left casing 212 when the cover piece 214 is closed.

Clamp 216 is operated by closing the cover piece 214 with the blade 208 in the position shown in FIG. 9 and the clamp turned to its counter-clockwise limit. To define this limit, a suitable stop (not shown) may be provided between the cover and the clamp. When the cover is closed, the clamp is turned in a clockwise direction to engage edges 252 in their respective recesses 226. Further turning in a clockwise direction compresses the cover against the blade, as the edges 252 advance in a screw-like fashion through recesses 226 of casing 212. Maximum compression may be reached at a clockwise limit of clamp 216.

The combination of a pivoting cover 214 and clamp 216 advantageously provides for quick and convenient clamping and un-clamping of blade 208, without requiring a threaded fastener. In the alternative, a conventional threaded fastener may be used for clamping the blade, as in prior-art utility knives, by passing through the blade and engaging the left casing 212. Of course, the movement mechanism and shield 202 should remain free to move through or around any clamped region. Other types of clamps may also be used, and the invention should not be limited to a blade clamp of a particular type.

The method of blade support used by knife 200 may also be of interest to one of ordinary skill, although the invention should not be limited to the particular embodiment described. Blade 208 rests on the mounting surface 268 of retainer 224. Bar 272 protrudes through a central opening 262 in blade 208. Bar 272 may be shaped so that it is closely accommodated by the opening, thereby ensuring precise locating of the blade relative to the retainer 224, in the plane of mounting surface 268. To avoid dulling of its cutting edges, retainer 224 should hold blade 208 so that its edges do not contact surfaces inside of channel 228. Accordingly, these edges are preserved, permitting renewal of the blade edges by opening the cover piece 214 and rotating the blade 180°, thereby doubling the blade life.

Retainer 224 further includes stand-offs 270 (shown in dashed line in FIG. 11) on the underside of the retainer. Stand-offs 270 may comprise cylindrical support legs, and are configured to engage in recesses 266 in the left casing 212. The stand-offs are positioned to pass through the guide slots 274 of shield 202. Stand-offs 270 may be configured to perform at least two separate functions: to provide support for the blade retainer 224 while leaving the shield 202 free to slide in channel 228 between the blade and the casing, and guiding shield 202 in cooperation with guide slots 274. The blade 208 may thus be securely clamped to the retainer 224, while leaving the shield 202 free to slide in channel 228 under the blade.

Knife 200 optionally includes an internal tray 220, a small portion of which is shown in FIGS. 5–6 at the rear of handle 204 near plunger 203. A plan view of tray 220 is shown in FIG. 11. Tray 220 may be pulled out of handle 204 through an opening near the rear of the handle. It may include a recess for holding spare utility blades, such as blade 286, or other useful implements. Tray 220 may be separated from plunger 203 by a partition 288.

Figure 12:
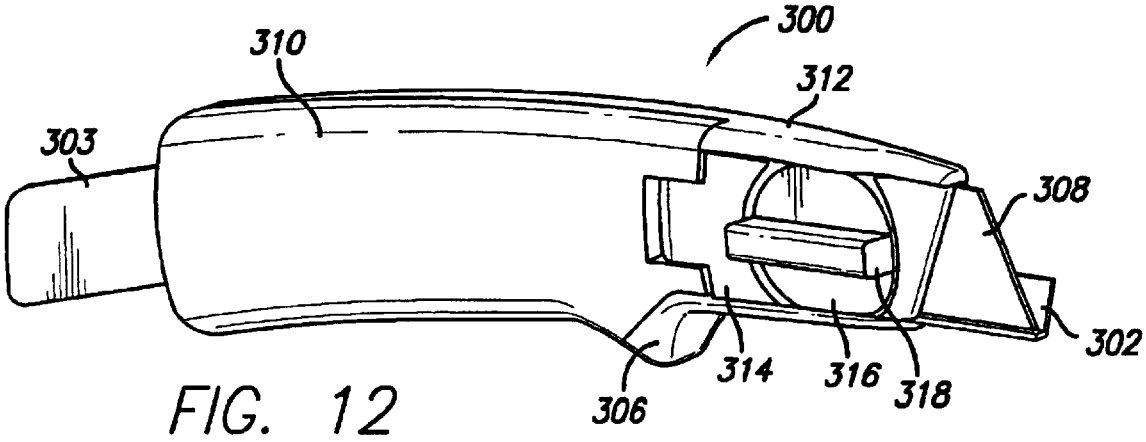
FIG. 12 is a perspective view of an exemplary utility knife according to an alternative embodiment of the invention, with the retractable shield in an extended position.
Figure 13:
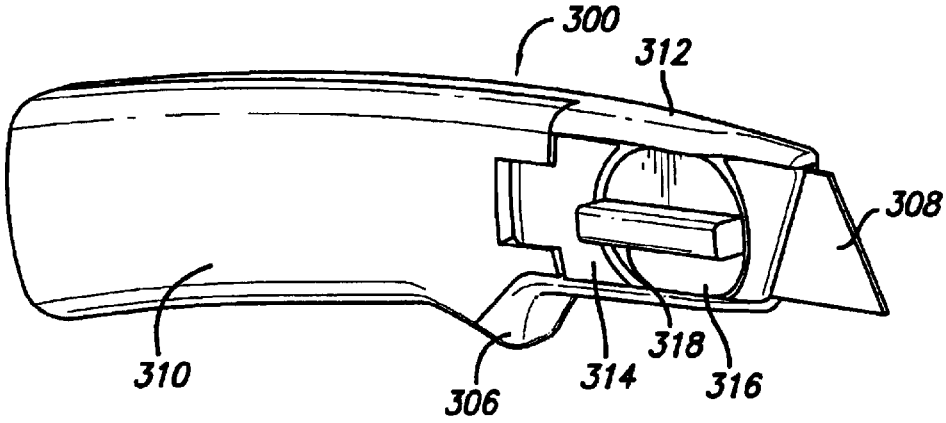
FIG. 13 is a perspective view of the knife shown in FIG. 12, with the retractable shield in a retracted position.
Figure 14:
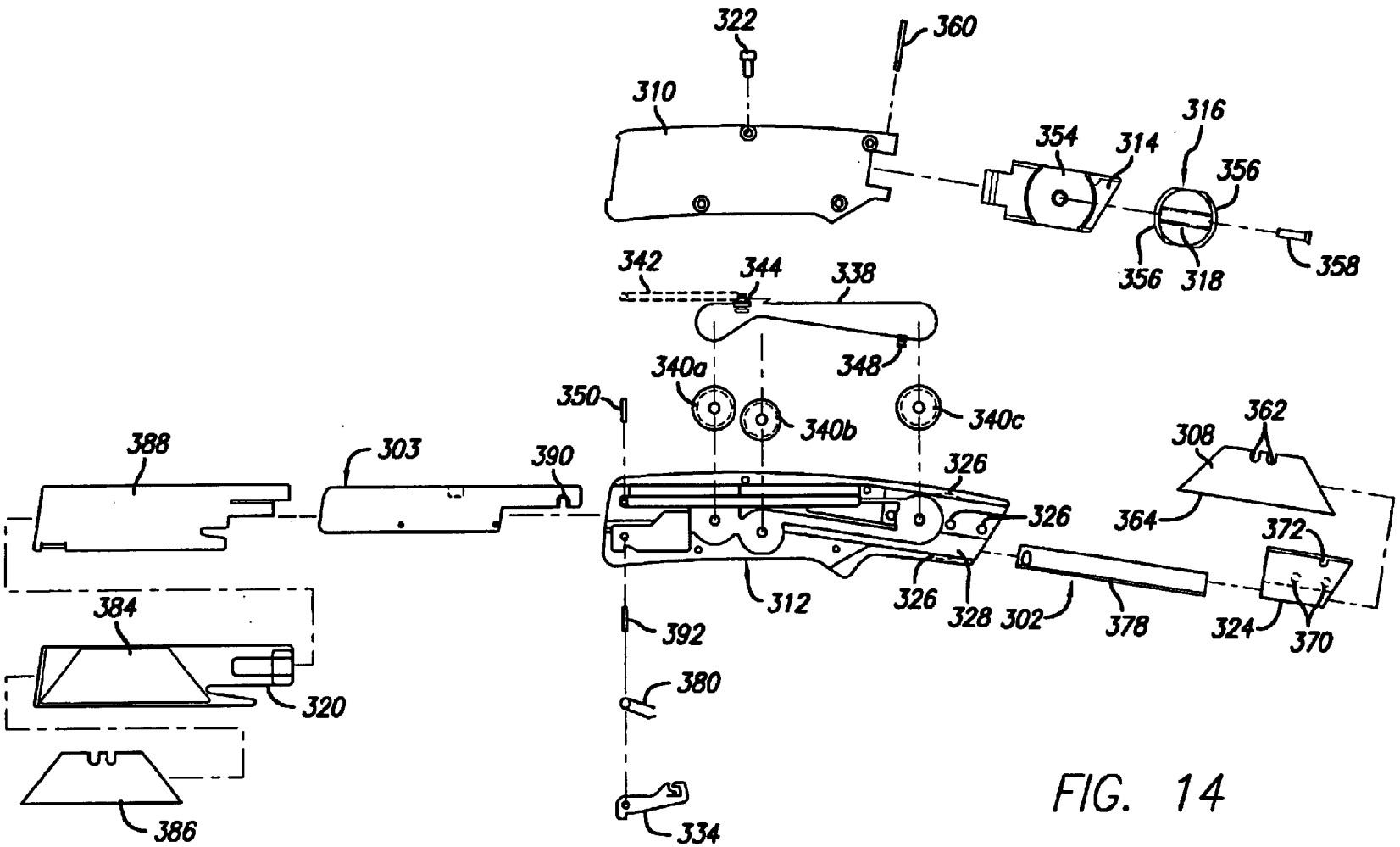
FIG. 14 is an exploded plan view of the knife shown in FIG. 12.

According to an alternative embodiment of the invention, a knife 300 is provided with a single-edged blade 308, as shown in FIGS. 12–14. Many of the other features of knife 200 have been adapted for use with knife 300. Despite its superficial resemblance to a traditional, sliding-blade-type utility knife, the knife 300 comprises a blade 308 that is fixed and immobile relative to the knife handle, like the blade 208 of knife 200. Knife 300 further comprises a handle comprising casings 310, 312, a hinged cover piece 314 and clamp 316 for clamping the blade, a plunger 303, and a shield 302. Shield 302 comprises an L-shaped bar. It is connected to plunger 303 by a reversing-type movement mechanism, similar to the movement mechanism of knife 200. FIG. 12 shows knife 300 with the plunger 303 and shield 302 in an extended position. Depressing the plunger causes the shield 302 to retract into the handle, to a position as shown in FIG. 13, in which a toggle latch deploys to maintain the position until the plunger is again depressed. The plunger also retracts into the handle, although a small portion (not visible in this view) should remain protruding from the handle.

Certain comparisons between knives 200 and 300 may be helpful. Repositioning or replacement of blade 308 may be accomplished similarly to knife 200. Clamp 316 may be similar to clamp 216 of knife 200. Blade 308 is of a single-edged type, and does not contain a central opening. The handle of knife 300 is straighter than the handle of knife 200. Accordingly, knife 300 includes components that are adapted to accommodate these and other differences from knife 200. Materials and construction of knife 300 may be generally similar to knife 200, with principle differences relating to the shape and arrangement of certain components. Like knife 200, knife 300 may include a similar finger grip 306 along the underside of the handle Components of knife 300 are shown in FIG. 14. Briefly, knife 300 comprises a right handle casing 310 attached to a left handle casing 312 by fasteners such as fastener 322. A pivoting cover piece 314 is pinned by pin 360 to casing 310. Cover 314 includes a circular recess 354 in which clamp 316 is positioned. Clamp 316 is fastened to cover 314 by a fastener 358. The clamp includes tapered edges 356, which cooperate with recesses 326 in the left handle casing to compress the cover 314 against blade 308 when the clamp is rotated. Clamp 314 may be grasped by bar 318. The operation of the cover and clamp may be generally similar to the cover and clamp for knife 200, previously described.

A movement mechanism, comprising loop 338 and pulleys 340*a–c*, is disposed in casing 312. Plunger 303 may be attached at opening 390 to fastener 344, and is shaped to slide in a corresponding channel of the left casing 312. A spring 342 may also be attached to loop 338, and connected to casing 312 by pin 350. Shield 302 is attached to loop 338 at fastener 348. A toggle latch 334 may be biased by spring 380 and attached to the casing by a pin 392. The movement mechanism is of a reversing type, and provides linear motion over a range substantially equal to the distance by which blade 308 extends from the handle.

Lip 378 of shield 302 is disposed adjacent to and covers the cutting edge 364 of blade 308. Blade 308 includes cut-outs 362 along an upper edge. Blade 308 is disposed on retainer 324, with one of cut-outs 362 engaging the semi-cylindrical retention feature 372. Coyer 314 clamps blade 308 to a flat bearing surface of the retainer 324. On an opposite side of the retainer, stand-offs 370 engage positioning holes 326 in the left casing 312. Shield 302 slides in channel 328, free and clear of the retainer.

Partition 388 may be used to separate the plunger 303 from a sliding tray 320. The partition may also assist guiding of the plunger and sliding tray in their motion into and out of the handle. Tray 320 may include a recess 384 for holding replacement blades, such as spare blade 386.

Having thus described a preferred embodiment of the utility knife, it should be apparent to those skilled in the art that certain advantages of the within system have been achieved. It should also be appreciated that various modifications, adaptations, and alternative embodiments thereof may be made within the scope and spirit of the present invention. For example, a utility knife with a shield attached to a reversing mechanism has been illustrated, but it should be apparent that the inventive concepts described above would be equally applicable to non-reversing mechanisms. The invention is further defined by the following claims.

What is claimed is:

1. A utility knife, comprising:

a handle;

a blade fixed to the handle, having a cutting edge extending from the handle for a fixed distance;

a movement mechanism mounted to the handle, the mechanism adapted to provide reversible motion relative to the blade and further comprising a toggle latch;

a shield connected to the movement mechanism and disposed adjacent to the blade, whereby the shield is movable between an extended position covering the cutting edge and a retracted position exposing the cutting edge; and an actuator connected to the movement mechanism, the actuator protruding from the handle, wherein the actuator moves the movement mechanism and the shield.

2. The utility knife of claim 1, wherein the movement mechanism further comprises a spring-loaded return biased to the handle.

3. The utility knife of claim 1, wherein the shield is substantially enclosed by the handle when the shield is in the retracted position.

4. The utility knife of claim 1, further comprising a tray slidably disposed inside of the handle, the tray comprising a spare blade holder.

5. The utility knife of claim 1, wherein the blade further comprises a thin metal piece with a razor-like edge and at least one mounting hole, and wherein the blade is removably fixed to the handle at least partially by engagement between the at least one mounting hole and a holding component of the handle.

6. The utility knife of claim 1, further comprising a finger grip protruding from an under surface of the handle, the finger grip contoured to fit between two fingers of a user's hand.

7. A utility knife, comprising:

a handle;

a blade fixed to the handle, having a cutting edge extending from the handle along an axis for a distance;

a linear movement mechanism at least partially enclosed by the handle, the mechanism adapted to provide reversible motion along the axis over the distance; and a shield connected to the linear movement mechanism and disposed adjacent to the blade, whereby the shield is movable between an extended position covering the cutting edge and a retracted position exposing the cutting edge; and an actuator connected to the linear movement mechanism, the actuator protruding from the handle, wherein the linear movement mechanism comprises a reversing mechanism configured to move the shield in a first direction when the actuator is moved in a direction opposite to the first direction.

8. The utility knife of claim 7, wherein the actuator comprises a plunger protruding from the handle at an end opposite from the blade.

9. The utility knife of claim 7, wherein the linear movement mechanism further comprises a spring-loaded return biased to the handle.

10. The utility knife of claim 7, wherein the linear movement mechanism further comprises a toggle latch.

11. The utility knife of claim 7, wherein the reversing mechanism comprises a loop of tensile material disposed around a plurality of pulleys.

12. The utility knife of claim 7, wherein the shield is substantially enclosed by the handle when the shield is in the retracted position.

13. The utility knife of claim 7, further comprising a tray slidably disposed inside of the handle, the tray comprising a spare blade holder.

14. The utility knife of claim 7, further comprising a rotating fastener clamping the blade to the handle.

15. The utility knife of claim 7, wherein the blade is fixed to the handle by a clamp assembly, the clamp assembly comprising a hinged cover and a rotating fastener on an exterior of the handle, and a blade holder disposed under the hinged cover in an interior of the handle.

16. The utility knife of claim 7, wherein the blade further comprises a second cutting edge parallel to the cutting edge, and wherein the shield covers the second cutting edge when the shield is in the extended position, and exposes the second cutting edge when the shield is in the retracted position.

17. The utility knife of claim 7, further comprising a finger grip protruding from an under surface of the handle, the finger grip contoured to fit between two fingers of a user's hand.

18. A utility knife, comprising:

a handle;

a blade fixed to the handle, having a cutting edge extending from the handle along an axis for a distance;

a shield disposed adjacent to the blade;

a reversible movement mechanism far moving the shield along the axis over the distance, the reversible movement mechanism disposed inside the handle and connected to the shield, whereby the shield is movable between an extended position covering the cutting edge and a retracted position exposing the cutting edge; and a clamp assembly connected to the handle, the clamp assembly comprising a cover hinged to the handle, and a fastener rotatably connected to the cover, the fastener configured for clamping the cover against a blade holder disposed in an interior of the handle.

19. The utility knife of claim 18, further comprising means for actuating the reversible movement mechanism.

20. The utility knife of claim 18, wherein the shield is substantially enclosed by the handle when the shield is in the retracted position.

21. The utility knife of claim 18, further comprising a tray slidably disposed inside of the handle, the tray comprising a spare blade holder.

22. The utility knife of claim 18, wherein the blade further comprises a second cutting edge parallel to the cutting edge, and wherein the shield covers the second cutting edge when the shield is in the extended position, and exposes the second cutting edge when the shield is in the retracted position.

23. The utility knife of claim 18, further comprising a finger grip protruding from an under surface of the handle, the finger grip contoured to fit between two fingers of a user's hand.

24. The utility knife of claim 18, wherein the fastener further comprises a rotating cam having an outer perimeter region configured to cooperate with the handle for clamping the cover to the blade holder.

25. The utility knife of claim 18, wherein the reversible movement mechanism is configured to move the shield while the cover is clamped to the blade holder.

* * * * *